US010569984B2

(12) United States Patent
Chatry et al.

(10) Patent No.: US 10,569,984 B2
(45) Date of Patent: Feb. 25, 2020

(54) DEVICE FOR LOADING INSERT SHEETS, STATION FOR RECEIVING BLANKS, MACHINE FOR PROCESSING ELEMENTS IN THE FORM OF SHEETS AND METHOD FOR TRANSPORTING AN INSERT SHEET

(71) Applicant: BOBST MEX SA, Mex (CH)

(72) Inventors: Patrice Chatry, Lugrin (FR); Anthony Paubel, Montagnat (FR); Maude Steiner, Morrens (CH)

(73) Assignee: BOBST MEX SA (CH)

( * ) Notice: Subject to any disclaimer, the term of this patent is extended or adjusted under 35 U.S.C. 154(b) by 0 days.

(21) Appl. No.: 16/076,361

(22) PCT Filed: Feb. 7, 2017

(86) PCT No.: PCT/EP2017/025022
§ 371 (c)(1),
(2) Date: Aug. 8, 2018

(87) PCT Pub. No.: WO2017/137170
PCT Pub. Date: Aug. 17, 2017

(65) Prior Publication Data

US 2019/0039847 A1 Feb. 7, 2019

(30) Foreign Application Priority Data

Feb. 12, 2016 (EP) ..... 16020042

(51) Int. Cl.
*B65H 31/32* (2006.01)
*B65H 29/04* (2006.01)
*B65H 33/04* (2006.01)

(52) U.S. Cl.
CPC ..... *B65H 29/044* (2013.01); *B65H 31/32* (2013.01); *B65H 33/04* (2013.01);
(Continued)

(58) Field of Classification Search
CPC ..... B65H 1/26; B65H 1/263; B65H 1/266; B65H 1/30; B65H 31/32; B65H 33/04;
(Continued)

(56) References Cited

U.S. PATENT DOCUMENTS

2015/0259170 A1* 9/2015 Fauconneau ..... B41F 19/064 156/433

FOREIGN PATENT DOCUMENTS

| | | | |
|---|---|---|---|
| DE | 195 16 023 | A1 | 11/1996 |
| EP | 1 153 871 | A2 | 11/2001 |
| WO | WO 2014/067611 | A1 | 5/2014 |

OTHER PUBLICATIONS

International Search Report dated May 4, 2017 in corresponding PCT International Application No. PCT/EP2017/025022.
(Continued)

*Primary Examiner* — David H Bollinger
(74) *Attorney, Agent, or Firm* — Ostrolenk Faber LLP

(57) ABSTRACT

An insert sheet loading device (10) comprising a movable carriage (12; 12') for inserting insert sheets into a receiving area (2) of a blank-receiving station (500). The movable carriage (12; 12') has a plurality of longitudinal bars (27*a*, 27*b*). At least one longitudinal bar (27*a*) has a suction channel (35) leading out, via at least one suction opening (30), onto the surface of the longitudinal bar (27*a*) for receiving an insert sheet, the suction channel (35) is connected to a vacuum source (31) for holding, by suction, the insert sheet transported by the movable carriage (12; 12'). Also a blank-receiving station, a sheet-shaped element processing machine, and a method for transporting an insert sheet in a receiving area of a blank-receiving station are disclosed.

16 Claims, 4 Drawing Sheets

(52) U.S. Cl.
CPC ..... *B65H 2301/4263* (2013.01); *B65H 2405/323* (2013.01); *B65H 2406/351* (2013.01); *B65H 2701/1764* (2013.01); *B65H 2701/18264* (2013.01); *B65H 2801/42* (2013.01)

(58) Field of Classification Search
CPC ..... B65H 2405/323; B65H 2406/351; B65H 2301/4263
See application file for complete search history.

(56) References Cited

OTHER PUBLICATIONS

Written Opinion dated May 4, 2017 in corresponding PCT International Application No. PCT/EP2017/025022.

* cited by examiner

Fig.6
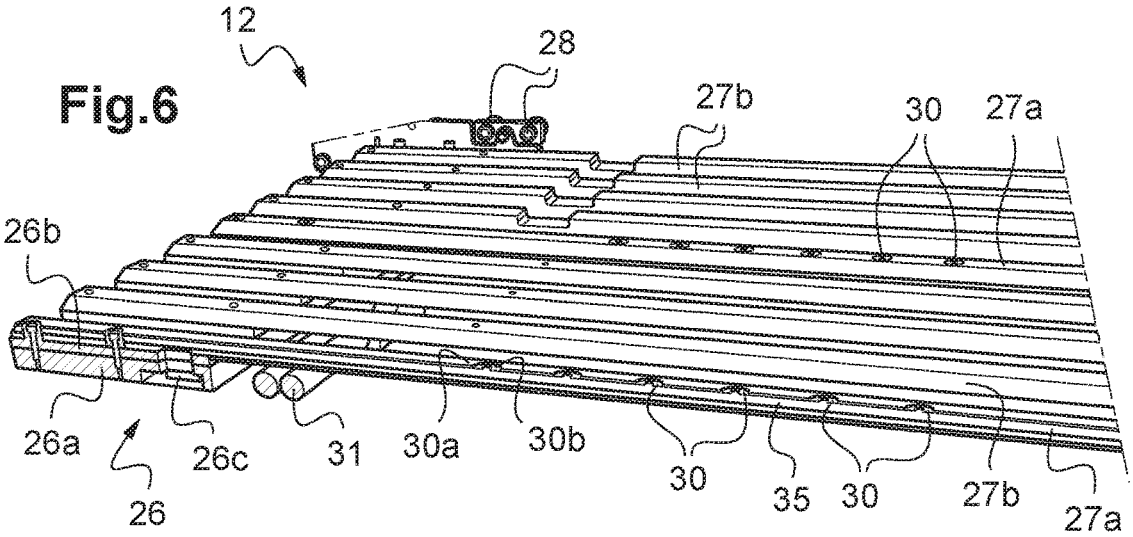
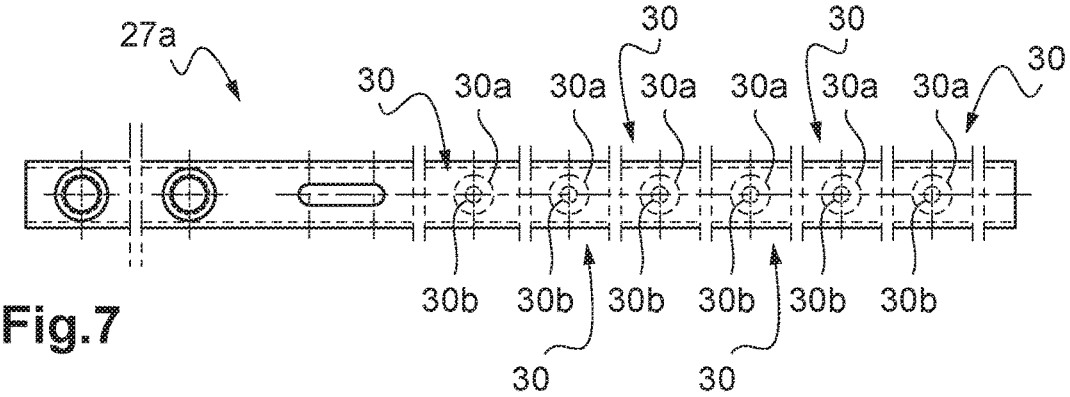
Fig.7
Fig.8
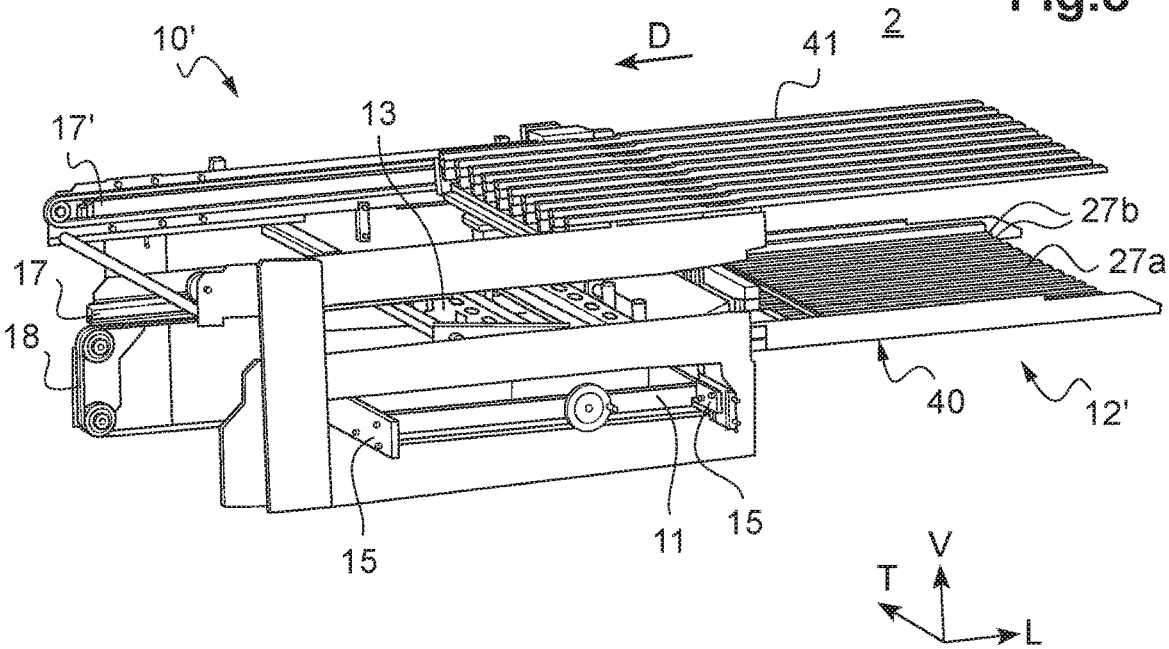

DEVICE FOR LOADING INSERT SHEETS, STATION FOR RECEIVING BLANKS, MACHINE FOR PROCESSING ELEMENTS IN THE FORM OF SHEETS AND METHOD FOR TRANSPORTING AN INSERT SHEET

CROSS-REFERENCE TO RELATED APPLICATIONS

The present application is a 35 U.S.C. §§ 371 national phase conversion of PCT/EP2017/025022, filed Feb. 7, 2017, which claims priority of European Patent Application No. 16020042.4, filed Feb. 12, 2016, the contents of which are incorporated by reference herein. The PCT International Application was published in the French language.

The present invention relates to a device for loading insert sheets for insertion between stacks of blanks in a receiving region of a station for receiving blanks. The present invention also relates to a station for receiving blanks, a machine for processing elements in the form of sheets and a method for transporting an insert sheet in a receiving region of a station for receiving blanks.

TECHNICAL BACKGROUND

In the receiving stations, after finishing and complete ejection of the waste, separation of the blanks consists in breaking the points of attachment between the blanks of a sheet by means of a male upper tool and a female lower tool mounted vertically above one another in the region for receiving sheets. The upper tool is formed by pusher elements which are slightly smaller than the periphery of the blanks. The lower tool is formed by a grid in which the shape of the openings generally corresponds to the periphery of the blanks. The blanks drop through these openings and are piled up in vertical stacks in the receiving region.

In order to form separated and stable stacks of blanks below these tools and on the receiving pallet of the station, periodic insertion of a stabilizing sheet has proven necessary. The insertion consists in arranging an insert sheet, such as a full sheet, between usually successive stacks of blanks. To perform this insertion without requiring a concomitant stopping of the production unit, a device commonly referred to as a non-stop receiving grid is used.

To perform an insertion operation, an insert sheet is grasped from a stack of insert sheets arranged in the vicinity of the receiving region. The insert sheet is then released onto the non-stop blank receiving grid. The non-stop receiving grid bearing the insert sheet is then moved below the lower tool for separating the blanks. The non-stop receiving grid then returns blanks above the stack of insert sheets to receive a new sheet. When leaving the receiving region, the grid crosses the teeth of a comb which has pivoted into the retaining position to retain the insert sheet and thus the blanks stacked on this insert sheet in the receiving region. The non-stop receiving grid thus makes it possible to deposit an insert sheet between the stacks of blanks and to support the blanks during the removal of the stacks of blanks without stopping the production.

Also known is a loading device provided with a mobile plate for performing only the insertion operations, with the support of the blanks during the removal of the stacks without stopping the production being provided by other means.

In order not to lower the quantity of blanks produced, the movement of the grid or of the plate bearing the insert sheet toward the receiving region must be carried out quickly in order to interleave the insert sheet between the last blank deposited on the top of the stack and the next blank as quickly as possible. Given the relatively large travel to be performed and the high production rates which can require movement speeds of the order of 1 m/s for the grid or the plate, it has proven to be difficult to maintain the insert sheet in position. In particular, the accelerations and decelerations may be too sudden to correctly drive the insert sheet. It may occur that, on its arrival in the receiving region, the insert sheet is offset or oriented awry and is thus poorly positioned between the blanks of the stack.

SUMMARY OF THE INVENTION

One object of the present invention is to propose an improved device for loading insert sheets that makes it possible to ensure the correct positioning of the insert sheet during its transportation in the receiving region.

Accordingly, one subject of the present invention is a device for loading insert sheets comprising a mobile carriage for the insertion of insert sheets in a receiving region of a station for receiving blanks. The mobile carriage comprises a plurality of longitudinal bars. At least one longitudinal bar comprises a suction duct that opens via at least one suction orifice onto the face of the longitudinal bar intended to receive an insert sheet. The suction duct is configured to be connected to a vacuum source in order to maintain, by suction, the insert sheet transported by the mobile carriage.

The insert sheet is thus well-maintained in position on the mobile carriage for its transportation toward the receiving region, in spite of the accelerations and decelerations of the mobile carriage.

According to one or more features of the device for loading insert sheets, taken alone or in combination,

- the at least one longitudinal bar having at least one suction orifice is a hollow profile having an interior that forms the suction duct,
- the mobile carriage comprises at least two longitudinal bars each having at least one suction orifice,
- at least one suction orifice is arranged in a central region of the mobile carriage,
- one longitudinal bar has a plurality of regularly spaced suction orifices,
- the suction orifice has a staged shape with at least a first stage having a first suction cross section and a second stage having a second suction cross section that is smaller than the first cross section, the first stage opening onto the face of the longitudinal bar intended to receive an insert sheet and the second stage opening into the suction duct,
- the suction cross sections of the first stage and of the second stage have concentric circular shapes,
- the ratio between the suction cross sections of the first and second stages is between 2 and 50,
- the suction duct of the longitudinal bar is connected to a hollow cross member of the mobile carriage,
- the mobile carriage is configured to form a non-stop receiving grid for blanks that is able to support blanks deposited on the insert sheet,
- the mobile carriage comprises a plate arranged below the longitudinal bars,
- the loading device comprises at least one rotating roller, which is elastically biased against the mobile carriage, for rolling on the insert sheet during the movement of the mobile carriage toward the receiving region, the rotating roller is configured to roll on the insert sheet along a longitudinal bar having at least one suction orifice, the loading device comprises at least one elastic strip of which a first end bears the rotating roller and a second end is fixed to a device for grasping sheets of the loading device.

Another subject of the invention is a station for receiving blanks of a machine for processing elements in the form of sheets, which comprises a device for loading insert sheets as described above.

Another subject of the invention is a machine for processing elements in the form of sheets, comprises a station for separating blanks as described above.

Yet another subject of the invention is a method for transporting an insert sheet in a receiving region of a station for receiving blanks by a loading device as described above, in which:

a low suction pressure is applied to at least one suction orifice of the mobile carriage when the mobile carriage bearing an insert sheet is controlled in movement toward the receiving region, and the low suction pressure is stopped when the mobile carriage stops in the receiving region.

Blowing can also take place through the at least one suction orifice of the mobile carriage when the mobile carriage has arrived in the receiving region and when the low suction pressure is stopped.

BRIEF DESCRIPTION OF THE DRAWINGS

Further advantages and features will become apparent from reading the description of the invention and from the appended figures, which show a nonlimiting exemplary embodiment of the invention and in which:

FIG. 6 shows a view in longitudinal section of the mobile carriage of FIG. 5.

FIG. 7 shows a schematic plan view of a longitudinal bar of the mobile carriage of FIG. 6.

FIG. 8 shows a second exemplary embodiment of a device for loading insert sheets with a non-stop receiving grid and a mobile carriage in the extended position.

DESCRIPTION OF EMBODIMENTS

In these figures, identical elements bear the same reference numbers. The following embodiments are examples. Although the description refers to one or more embodiments, this does not necessarily mean that each reference concerns the same embodiment, or that the features apply only to a single embodiment. Simple features of various embodiments can also be combined or interchanged to provide other embodiments.

Figure 1:
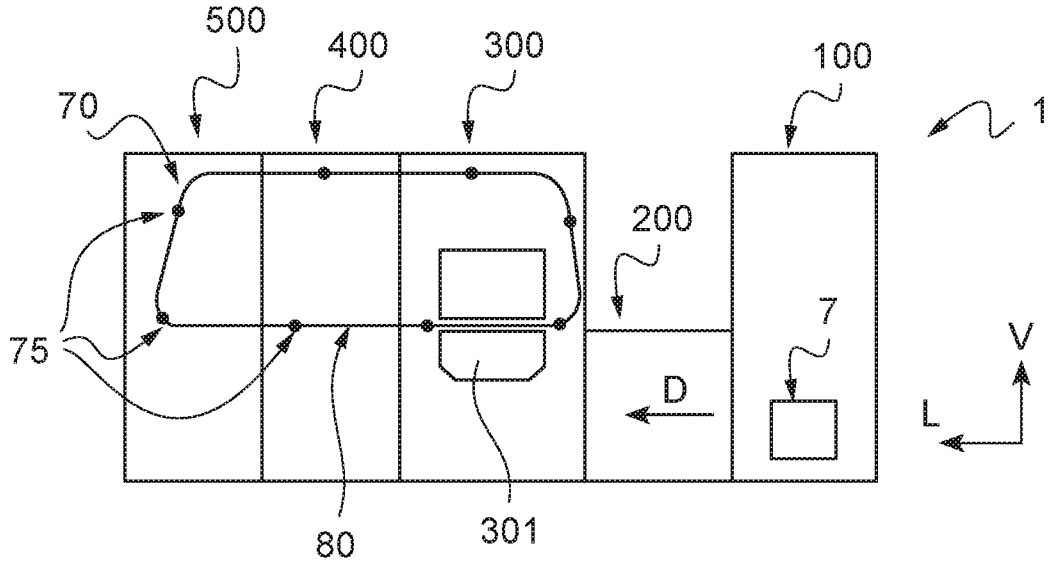
FIG. 1 illustrates highly schematically an example of a machine for processing elements in the form of sheets.
Figure 2:
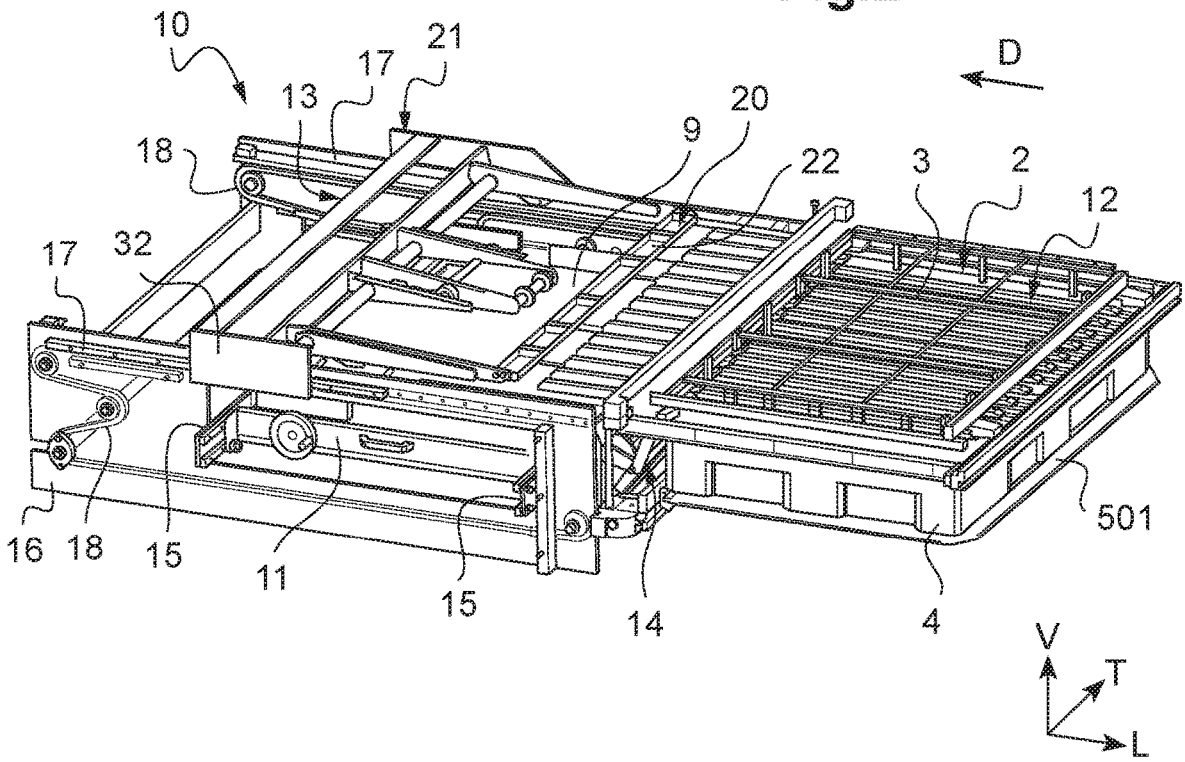
FIG. 2 shows a first exemplary embodiment of a device for loading insert sheets, arranged beside a region for receiving blanks, with a mobile carriage situated in the receiving region and a device for grasping insert sheets in the upper position.

The longitudinal, vertical and transverse directions indicated in FIG. 2 are designated by the trihedron (L, V, T). The transverse direction T is the direction perpendicular to the longitudinal direction of movement D of a sheet, as illustrated by the arrow D in FIGS. 1 and 2. The horizontal plane corresponds to the plane (L, T).

The terms upstream and downstream are defined with reference to the longitudinal direction of movement D. The sheets move from upstream to downstream, generally following the longitudinal main axis of the machine, in a movement timed by periodic stops.

The terms "flat elements" and "sheets" will be considered as equivalent and will equally concern elements composed of corrugated cardboard and flat cardboard, paper or any other material commonly used in the packaging industry. It will be understood that throughout this text the terms "sheet" or "sheet element" or "element in the form of sheets" designates very generally any printing medium in the form of sheets, such as, for example, sheets of cardboard, of paper, of plastic, etc.

FIG. 1 represents an example of a processing machine 1 for the transformation of sheets. This processing machine 1 is conventionally composed of a plurality of workstations which are juxtaposed but interdependent on one another to form a unitary assembly. There is thus an introduction station 100, a feed table 200, a transformation station 300 for cutting the sheets, for example comprising a platen press 301, a station 400 for ejecting waste, and a station 500 for receiving blanks, where the transformed sheets are restacked and the cut sheet waste is removed.

The operation of transforming each sheet takes place in the transformation station 300, for example between a fixed platen and a lower movable platen of the press 301 for cutting the sheets in accordance with a matrix corresponding to the developed shape that is desired to be obtained, for example with a view to obtaining a plurality of boxes of a given shape. The movable platen rises and falls successively once during each machine cycle.

A transport device 70 is moreover provided to individually move each sheet from the outlet of the feed table 200 to the station 500 for receiving blanks while passing through the press-transformation station 300.

The transport device 70 comprises a plurality of transverse bars provided with grippers, commonly referred to as gripper bars 75, which each in turn grasp a sheet at its front edge before pulling the sheet successively through the different workstations 300, 400, 500 of the machine 1.

The ends of the gripper bars 75 are each respectively connected to a lateral chain forming a loop, commonly referred to as a chain system 80. Two chain systems 80 are thus arranged laterally on either side of the gripper bars 75.

By virtue of movement transmitted to the chain systems 80, all the gripper bars 75 will start from a stopped position, accelerate, reach a maximum speed, decelerate and then stop, thus describing a cycle corresponding to the movement of a sheet from one workstation to the following workstation. The chain systems 80 move and stop periodically such that, during each movement, all the gripper bars 75 in engagement with a sheet are passed from one station to the adjacent downstream workstation. Each station performs its work in synchronization with this cycle, which is commonly referred to as the machine cycle. The workstations are in the initial position to start new work upon each start of the machine cycle.

The number and the nature of the processing stations in a processing machine 1 can vary as a function of the nature and the complexity of the operations to be performed on the sheets. Within the context of the invention, the notion of processing machine thus covers a very large number of embodiments owing to the modular structure of these assemblies. Depending on the number, the nature and the arrangement of the workstations used, it is in fact possible to obtain a multitude of different processing machines. It is also important to stress that there are other types of workstations than those mentioned, such as stations for embossing, scoring or such as stations for loading strips to be stamped for a stamping machine or hot foil stamping machine, where patterns obtained from a foil originating from one or more strips to be stamped are applied to each sheet between the platens of a press. Finally, it will be understood that the same processing machine can very well be equipped with a plurality of stations of the same type.

In the station 500 for receiving blanks, after finishing in the transformation station 300 and ejecting the waste in the station 400 for ejecting waste, the points of attachment between the blanks of a sheet are broken by means of a male upper tool and a female lower tool mounted vertically above one another in a receiving region 2 represented in FIG. 2.

The upper tool is formed by pusher elements which are slightly smaller than the periphery of the blanks. The lower tool 3 is formed by a grid in which the shape of the openings generally corresponds to the periphery of the blanks. In the example, the lower tool 3 comprises longitudinal and transverse bars forming a grid with square openings, for example. The blanks drop through the openings of this grid and are piled in vertical stacks in the receiving region 2 on a receiving pallet 4 borne by a vertically movable frame 501 of the station 500.

The station 500 for receiving blanks comprises a device 10 for loading insert sheets that is fixed to the frame of the machine 1. The insertion consists in arranging an insert sheet, such as a full sheet, between stacks of blanks in the receiving region 2.

The loading device 10 comprises a reserve tray 11 for insert sheets, a mobile carriage 12, a device 13 for grasping insert sheets and a pivoting retaining comb 14.

The tray 11 comprises a housing 9 intended to receive a stack of insert sheets. The tray 11 is movable translationally in the transverse direction T in order to be able to be reloaded by an operator through an aperture in the frame 16 of the loading device 10 from one side of the loading device 10. The tray 11 can be mounted on two transverse slide rails 15 and comprise a handle, like a drawer.

The mobile carriage 12 is movable translationally in the longitudinal direction of movement D of the sheets between a retracted position above the tray 11 for receiving an insert sheet (FIG. 3) and an extended position for the insertion of the insert sheet in the receiving region 2 (FIG. 2).

Figure 5:
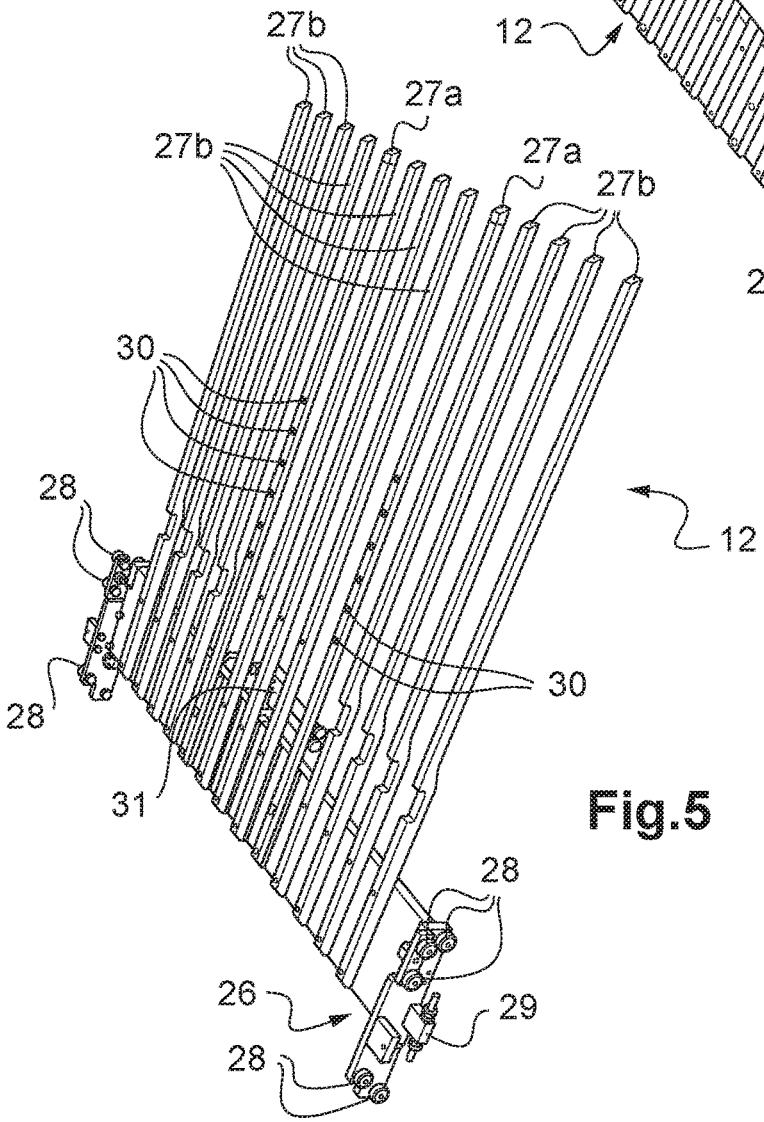
FIG. 5 shows a perspective view of the mobile carriage of FIG. 4.

As can be seen in FIG. 5, the mobile carriage 12 comprises at least one crossmember 26 and a plurality of longitudinal bars 27*a*, 27*b* which are fixed and borne by the crossmember 26. The mobile carriage 12 comprises, for example, a number of longitudinal bars 27*a*, 279*b* between 6 and 25, the number being adapted to the format of the insert sheets.

The lateral ends of the crossmember 26 are, for example, provided with rotating rollers 28 cooperating with longitudinal slide rails 17 borne by the frame 16. The mobile carriage 12 comprises, for example, six rotating rollers 28 at each end of the crossmember 26 (five rotating about a transverse axis for longitudinal guidance and one rotating about a vertical axis for lateral guidance). The mobile carriage 12 can be driven translationally by two chains 18 or belt(s) or rack(s), driven, for example, by a motor (not visible) controlled by a control unit 7 of the processing machine 1 in order to program an insertion when the stack of blanks reaches the desired height. The chains 18 are connected by a respective fixing element 29 borne by a respective end of the crossmember 26.

The retaining comb 14 comprises teeth which are regularly spaced in the transverse direction. The comb 14 is pivotably mounted about a transverse axle interposed between the tray 11 and the region 2 for receiving blanks. The comb 14 pivots between a retaining position in which the teeth of the comb 14 pass between the longitudinal bars 27*a*, 27*b* of the mobile carriage 12 and a released position in which the teeth of the comb 14 are retracted.

Figure 3:
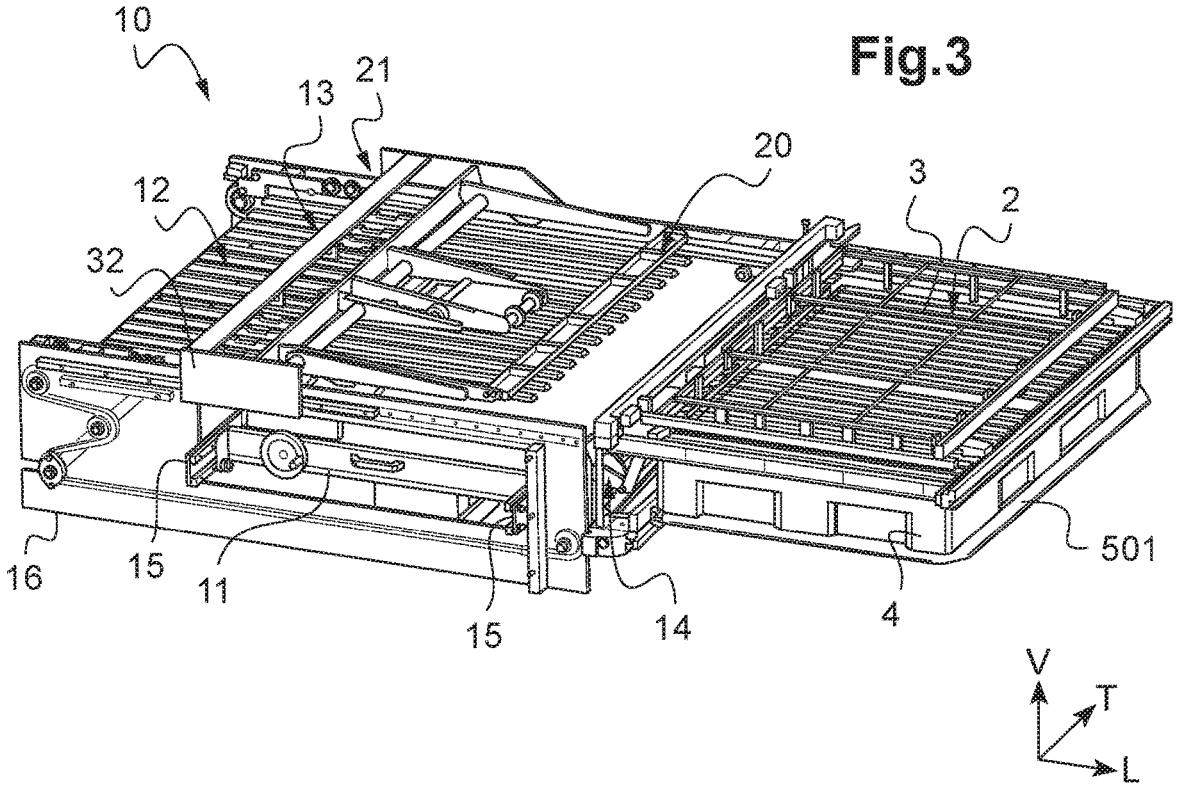
FIG. 3 is a view similar to FIG. 2 with the mobile carriage situated above a reserve tray for insert sheets.
Figure 4:
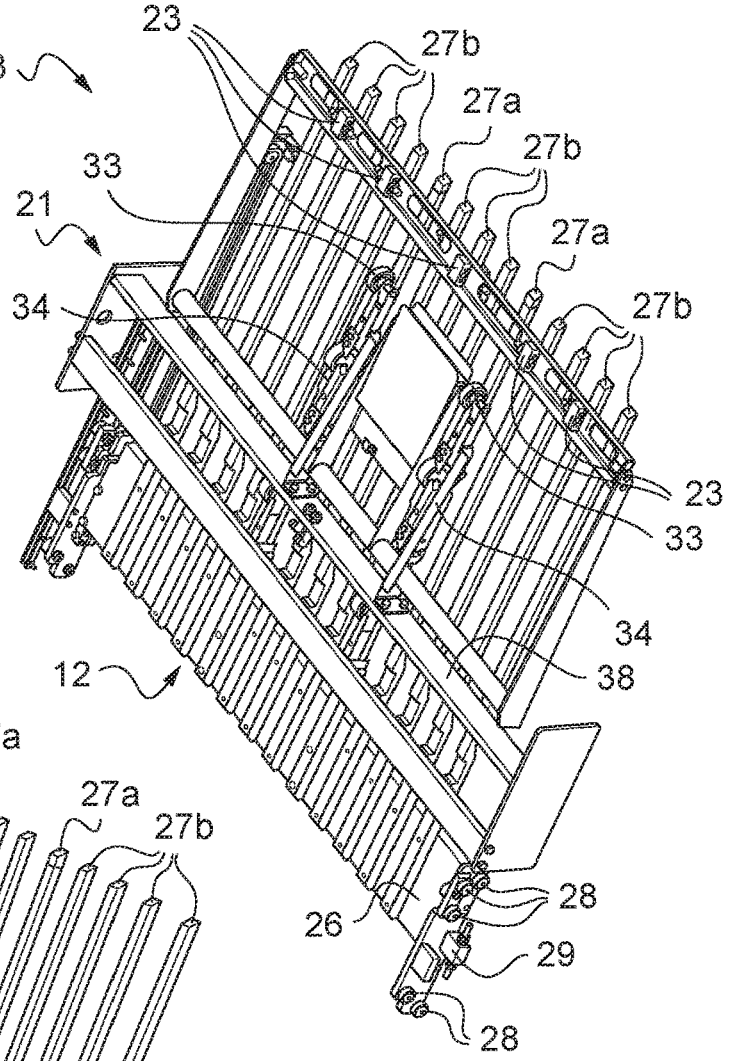
FIG. 4 shows a perspective view of the mobile carriage and of the grasping device of FIG. 2.

The device 13 for grasping insert sheets is arranged above the mobile carriage 12 in the retracted position (FIG. 3). The grasping device 13 is configured to lift an insert sheet from the insert sheet reserve tray 11 and to deposit the lifted insert sheet on the mobile carriage 12.

It comprises a suction element 20 configured to grasp an insert sheet and a support 21 mounted on the frame 16 for moving the suction element 20 between a lower position toward the stack of insert sheets and an upper position away from the stack of insert sheets. The support 21 can be mounted so as to slide longitudinally on the frame 16 in order to adapt the longitudinal positioning of the grasping region to the format of the insert sheets.

The suction element 20 is connected to a vacuum source, such as a vacuum pump or a Venturi device, for example by means of hoses. According to one exemplary embodiment, the suction element 20 comprises a transverse suction bar provided with pivoting suction cups 23.

At least one longitudinal bar 27*a* of the mobile carriage 12 comprises a suction duct 35 opening via at least one suction orifice 30 onto the face of the longitudinal bar 27*a* intended to receive an insert sheet, that is the upper face when the mobile carriage 12 is mounted in the station 500 for receiving blanks.

The suction duct 35 is configured to be connected to a vacuum source 31 in order to maintain by suction the insert sheet transported by the mobile carriage 12. The insert sheet can thus be maintained in position on the mobile carriage 12 for its transportation toward the receiving region 2, in spite of the rapid movement speed of the mobile carriage 12.

For example, the mobile carriage 12 comprises at least two longitudinal bars 27*a* each having a suction duct 35 opening via at least one suction orifice 30. The insert sheet can thus be maintained at minimum at two points, thereby making it possible to avoid the angular offsetting of the insert sheet, in particular for sheets of small format.

There is provision, for example, that same longitudinal bar 27*a* has a plurality of regularly spaced suction orifices 30, for example six.

The suction orifices 30 can be arranged in a central region of the mobile carriage 12 such that they are covered by the insert sheet for all sheet formats. A situation is thus avoided in which some suction orifices suck vacuum, which could prevent the other suction orifices 30 from operating correctly.

For example, two first longitudinal bars 27*a* are at least spaced by one second longitudinal bar 27*b*. The two first longitudinal bars 27*a* are, for example, spaced by three second longitudinal bars 27*b*. The first longitudinal bars 27*a* are, for example, identical in order to symmetrically arrange the suction orifices 30 of the various longitudinal bars 27*a*.

The vacuum source 31, such as a vacuum pump or a Venturi device, is connected to the mobile carriage 12, for example by means of hoses for adapting the length of the lines to the position of the mobile carriage 12. The vacuum source 31 is controlled by the control unit 7 to establish a low suction pressure in the suction orifices 30 or to stop the suction in the latter.

In the example, the vacuum source 31 is a Venturi device fixed below the mobile carriage 12 (FIG. 5). A flexible line (not shown) comprises a first end connected to the vacuum source 31 and a second end connected to an air supply. The flexible line therefore has an end fixed to the frame 16 and a movable end moving with the back-and-forth movement of the carriage 12.

According to one exemplary embodiment, the longitudinal bars 27*a* having at least one suction orifice 30 are hollow profiles, such as a tube of rectangular (or square) cross section and whose interior forms the suction duct 35.

The suction ducts 35 of the longitudinal bars 27*a* can be connected to the crossmember 26 of the mobile carriage 12, likewise designed to be hollow. The vacuum source 31 can then be connected to an end of the crossmember 26. The mobile carriage 12 thus serves as a fluid line for conveying the low suction pressure to the various suction orifices 30.

The at least one suction duct 35 can also be configured to be connected to a gas source, such as an air source, for blowing to take place through the at least one suction orifice 30 in order to facilitate the release of the insert sheet once it has arrived at its destination in the receiving region 2.

According to one exemplary embodiment visible in the sectional view of FIG. 6, the crossmember 26 comprises a base 26*a* and a closure plate 26*b* closing the base 26*a*. A transverse duct 26*c* is formed in the base 26*a* and opens at a lateral end of the crossmember 26 to which the vacuum source 31 (and the gas source, where appropriate) can be connected to the end situated on the left in FIG. 5). At least one hole is formed in the closure plate 26*b*, the hole communicating with the suction duct 35 of the longitudinal bars 27*a*.

According to one exemplary embodiment, the suction orifice 30 has a staged shape (FIG. 6) with at least a first stage 30*a* having a first suction cross section and a second stage 30*b* having a second suction cross section that is smaller than the first suction cross section. The first stage 30*a* opens onto the face of the longitudinal bar 27*a* intended to receive the insert sheet and the second stage 30*b* opens into the suction duct 35 (FIG. 7).

The larger suction cross section of the first stage 30*a* makes it possible to distribute the suction force below the surface of the insert sheet with a large grasping surface, which is useful for particularly rigid sheets. The smaller suction cross section of the second stage 30*a* makes it possible to grasp a flexible insert sheet without deforming it.

Moreover, given that the suction rate is limited to the small suction cross section of the second stage 30*b*, the other suction orifices 30 are allowed to operate even if a suction orifice 30 is not covered by the insert sheet.

The suction cross sections of the first and second stage 30*a*, 30*b* have, for example, concentric circular shapes. A two-stage orifice formed by two cylindrical holes of different diameters is particularly simple to produce and makes it possible to obtain the desired effect with a small thickness, such as a sheet metal thickness, of the order of 2 mm.

The ratio between the suction cross sections is, for example, between 2 and 50. In the case of circular suction cross sections, the diameter of the suction cross section of the second stage 30*b* can be between 3 and 9 mm, such as of the order of 6 mm, and the diameter of the suction cross section of the first stage 30*a* can be between 14 and 20 mm, such as of the order of 17 mm. The loading device 10 can additionally comprise at least one rotating roller 33. The rotating roller 33 is elastically biased against the mobile carriage 12 to roll on the insert sheet during the movement of the mobile carriage 12 toward the receiving region 2. The rotating roller 33 thus makes it possible to press on the insert sheet borne by the mobile carriage 12 against the suction orifices 30 to facilitate retention thereof. This is particularly useful for thick and rigid insert sheets, such as those made of cardboard.

More precisely, the rotating roller 33 can be configured to roll on the insert sheet along a longitudinal bar 27*a* having at least one suction orifice 30. There is provision, for example, for there to be as many rotating rollers 33 as longitudinal bars 27*a* having suction orifices 30.

The element on which the rotating roller 33 is mounted comprises, for example, an elastic strip 34 having a first end at which the rotating roller 33 is mounted. The second end of the elastic strip 34 is, for example, fixed to the support 21 of the device 13 for grasping insert sheets, such that the rotating rollers 33 are situated above the longitudinal bars 27*a* and can exert a pressure on the insert sheet.

The method for transporting an insert sheet in the receiving region 2 will now be described. The starting position is considered to be the extended position of the mobile carriage 12 in the receiving region 2 away from the tray 11 (FIG. 2). The suction element 20 is in the upper position.

The suction element 20 is moved into the lower position in order to grasp and lift an insert sheet from the housing 9 of the tray 11. The insert sheet is then released onto the mobile carriage 12 returning from the receiving region 2 into the retracted position (FIG. 3) and covers the suction orifices 30.

The control unit 7 controls a low suction pressure in the suction orifices 30 to fix the insert sheet to the mobile carriage 12 and controls the movement of the mobile carriage 12 toward the receiving region 2.

Upon the start of the mobile carriage 12, the rotating rollers 33 roll on the insert sheet along the longitudinal bars 27, pressing the insert sheet against the suction orifices 30.

The insert sheet is thus maintained in position for its transportation toward the receiving region 2, in spite of the accelerations and decelerations of the mobile carriage 12.

On arrival of the mobile carriage 12 below the lower tool 3 for separating the blanks, the control unit 7 stops the low suction pressure in the suction orifices 30. The insert sheet is thus no longer retained.

Air can be blown through the at least one suction orifice 30 of the mobile carriage 12 in order to more easily detach the insert sheet from the mobile carriage 12 once the mobile carriage 12 has arrived in the receiving region 2 and the low suction pressure is stopped.

The mobile carriage 12 then returns above the stack of insert sheets to receive a new sheet. When leaving the receiving region 2, the mobile carriage 12 crosses the teeth of the retaining comb 14 which has pivoted into the retaining position (FIG. 2) to retain the insert sheet on which a new stack can be deposited. The insert sheet, thus well-positioned on the mobile carriage 12, can hence be well-positioned between the blanks of the stack.

In this embodiment, the mobile carriage 12 also serves as a non-stop receiving grid for blanks. It makes it possible to support the blanks deposited on the insert sheet during the removal of the receiving pallet 4 bearing the complete stacks of blanks outside the receiving station and the insertion of a new empty receiving pallet 4 without stopping the production.

According to another embodiment visible in FIG. 8, the mobile carriage 12' comprises a plate 40 arranged below the longitudinal bars 27*a*, 27*b* and fixed thereto.

The suction ducts 35 of the longitudinal bars 27*a* can be connected to a duct formed in the plate 40, replacing the crossmember 26.

The carriage 12' is movable between a retracted position for receiving an insert sheet and an extended position for depositing the insert sheet in the receiving region 2 between the stacks of blanks. The mobile carriage 12' can be driven translationally by two chains 18 or belt(s) or rack(s) driven by an actuator, such as a pneumatic linear jack (not visible), controlled by the control unit 7 of the processing machine 1 in order to program an insertion when the stack of blanks reaches the desired height.

However, in this second embodiment, the support of the blanks during the removal of the stacks of blanks without stopping the production is provided by a separate non-stop receiving grid 41 for blanks that is situated above the mobile carriage 12'.

The non-stop receiving grid 41 for blanks comprises a plurality of longitudinal bars. It is movable in the longitudinal direction L between a retracted position in which it is situated above the grasping device 13 and an extended position in the receiving region 2 of the station 500 for receiving blanks in order to receive the blanks during the removal of the receiving pallet 4. The non-stop receiving grid 41 for blanks is also movable vertically by a motorized drive in order to adapt to the level of accumulation of the blanks on the plate 40. The non-stop receiving grid 41 for blanks does not provide the insertion function.

It should also be noted that the invention is not limited to a station 500 for receiving blanks in which the points of attachment between the blanks are separated, but can be applied to a station for receiving blanks that receives stacks of full sheets.

The invention claimed is:

1. A loading device for loading insert sheets into a stack of blanks, the loading device comprising:

a mobile carriage for insertion of insert sheets in a receiving region of a station for receiving the blanks;

the mobile carriage comprising a plurality of longitudinal bars at least one of the longitudinal bars comprises a suction duct opening comprising at least one suction orifice onto the face of the longitudinal bar such that the at least one suction orifice is configured to receive an insert sheet, the suction duct being configured to be connected to a vacuum source in order to maintain by suction the insert sheet transported by the mobile carriage, wherein the suction orifice has a staged shape including at least a first stage having a first suction cross section and a second stage having a second suction cross section that is smaller than the first suction cross section;

the first stage opening onto the face of the at least one longitudinal bar configured to receive an insert sheet; and the second stage opening into the suction duct.

2. A loading device according to claim 1, wherein the at least one longitudinal bar has at least one suction orifice is a hollow profile having an interior which forms the suction duct.

3. A loading device according to claim 1, wherein the plurality of longitudinal bars comprises two longitudinal bars, each of the two longitudinal bars having at least one suction orifice.

4. A loading device according to claim 1, wherein at least one of the suction orifices is arranged in a central region of the mobile carriage.

5. A loading device according to claim 1, wherein the at least one of the longitudinal bars has a plurality of regularly spaced suction orifices.

6. A loading device according to claim 5, wherein the suction duct of the at least one longitudinal bar is connected to a hollow crossmember of the mobile carriage.

7. A loading device according to claim 1, wherein the suction cross sections of the first stage and of the second stage have concentric circular shapes.

8. A loading device according to claim 1, wherein a ratio between the suction cross section of the first stage and the cross section of the second stage is between 2 and 50.

9. A loading device according to claim 1, wherein the loading device is configured to form a non-stop receiving grid for blanks that is configured to support blanks deposited on the insert sheet.

10. A loading device according to claim 1, further comprising a plate arranged below the at least one longitudinal bars.

11. A station for receiving blanks of a machine for processing elements in the form of sheets, the station comprising the loading device according to claim 1.

12. A machine for processing elements in the form of sheets, the machine comprising the station for separating blanks according to claim 11.

13. A loading device for loading insert sheets into a stack of blanks, the loading device comprising:

a mobile carriage for insertion of insert sheets in a receiving region of a station for receiving the blanks;

the mobile carriage comprising a plurality of longitudinal bars at least one of the longitudinal bars comprises a suction duct opening comprising at least one suction orifice onto the face of the longitudinal bar such that the at least one suction orifice is configured to receive an insert sheet, the suction duct being configured to be connected to a vacuum source in order to maintain by suction the insert sheet transported by the mobile carriage; at least one rotating roller elastically biased against the mobile carriage, for rolling on the insert sheet during the movement of the mobile carriage toward the receiving region.

14. A loading device according to claim 13, wherein the rotating roller is configured to roll on the insert sheet along a longitudinal bar having at least one suction orifice.

15. A loading device according to claim 13, further comprising at least one elastic strip having a first end which bears the rotating roller and a second end to a device for grasping sheets of the loading device.

16. A method for transporting an insert sheet in a receiving region of a station for receiving blanks by a loading device for loading insert sheets into a stack of blanks, the loading device including:

a mobile carriage for insertion of insert sheets in a receiving region of a station for receiving the blanks;

the mobile carriage comprising a plurality of longitudinal bars at least one of the longitudinal bars comprises a suction duct opening comprising at least one suction orifice onto the face of the longitudinal bar such that the at least one suction orifice is configured to receive an insert sheet, the suction duct being configured to be connected to a vacuum source in order to maintain by suction the insert sheet transported by the mobile carriage, the method comprising:

applying a low suction pressure to at least one suction orifice of the mobile carriage when the mobile carriage bears an insert sheet and is controlled in movement toward the receiving region; and stopping the low suction pressure when the mobile carriage stops in the receiving region, wherein blowing takes place through the at least one suction orifice of the mobile carriage when the mobile carriage is in the receiving region and the low suction pressure is stopped.

* * * * *